US011668319B2

(12) United States Patent
Boulanger et al.

(10) Patent No.: US 11,668,319 B2
(45) Date of Patent: Jun. 6, 2023

(54) BLOWER UNIT

(71) Applicant: Speed to Market LTD., Hong Kong (CN)

(72) Inventors: Dave Boulanger, Hong Kong (CN); Bob Cheung, Shenzhen (CN)

( * ) Notice: Subject to any disclaimer, the term of this patent is extended or adjusted under 35 U.S.C. 154(b) by 0 days.

(21) Appl. No.: 17/361,382

(22) Filed: Jun. 29, 2021

(65) Prior Publication Data

US 2021/0404482 A1 Dec. 30, 2021

Related U.S. Application Data

(60) Provisional application No. 63/058,757, filed on Jul. 30, 2020, provisional application No. 63/045,520, filed on Jun. 29, 2020.

(51) Int. Cl.

| | |
|---|---|
| ***F04D 29/42*** | (2006.01) |
| ***F04D 29/28*** | (2006.01) |
| ***F04D 25/06*** | (2006.01) |
| ***F04D 29/62*** | (2006.01) |
| ***F04D 29/66*** | (2006.01) |

(52) U.S. Cl.

CPC ..... *F04D 29/4226* (2013.01); *F04D 25/0693* (2013.01); *F04D 29/281* (2013.01); *F04D 29/626* (2013.01); *F04D 29/664* (2013.01)

(58) Field of Classification Search

CPC ..... F04D 13/0693; F04D 25/0693; F04D 29/4226; F04D 29/626; F04D 29/663–664; F04D 39/0027–005; A61M 16/0066; A61M 2205/3606; A61M 2205/3368; A61M 2205/42; A61M 2205/362

USPC ..... 417/312

See application file for complete search history.

(56) References Cited

U.S. PATENT DOCUMENTS

| | | | | |
|---|---|---|---|---|
| 2,464,552 A * | 3/1949 | Breuer | A47L 5/24 | 417/234 |
| 2,690,294 A * | 9/1954 | Cary | F04D 29/541 | 417/423.15 |
| 3,102,483 A * | 9/1963 | Najimian, Jr. | F04D 29/708 | 310/91 |
| 3,322,331 A * | 5/1967 | Kenny | F04D 17/04 | 310/91 |
| 3,346,174 A * | 10/1967 | Lievens | F04D 29/661 | 415/222 |
| 4,085,726 A * | 4/1978 | Van Boven | F24H 9/0073 | 174/68.3 |

(Continued)

FOREIGN PATENT DOCUMENTS

GB 2465392 A * 5/2010 ..... F04D 13/0606

*Primary Examiner* — Alexander B Comley
(74) *Attorney, Agent, or Firm* — Black Mccuskey

(57) ABSTRACT

A blower unit can include an outer housing, an inlet subassembly, a fan subassembly, an outlet subassembly, and a grommet. The outer housing can have an aperture extend along a first axis between first and second ends. The inlet subassembly can be received in the first end of the aperture. The fan subassembly can be received in the aperture adjacent to the inlet subassembly and include at least one wire. The outlet subassembly can be received in the second end. The grommet can be positioned between at least part of the second end and the outlet subassembly. The at least one wire can extend through the grommet. The grommet can seal against the at least one wire. The grommet can seal between the outer housing and the outlet subassembly.

22 Claims, 13 Drawing Sheets

(56) References Cited

U.S. PATENT DOCUMENTS

| | | | | |
|---|---|---|---|---|
| 4,264,282 | A * | 4/1981 | Crago | F04B 39/0038 417/243 |
| 4,508,486 | A * | 4/1985 | Tinker | F04D 29/664 415/197 |
| 4,997,342 | A * | 3/1991 | Conger, IV | F04D 29/668 415/214.1 |
| 5,567,127 | A * | 10/1996 | Wentz | F04D 29/663 417/423.9 |
| 8,096,783 | B2 | 1/2012 | Grasmuck | |
| 8,167,542 | B1 * | 5/2012 | Owusu | F04D 17/04 416/246 |
| 8,734,097 | B2 | 5/2014 | Kenyon | |
| 9,616,188 | B2 | 4/2017 | Grasmuck | |
| 10,655,640 | B1 * | 5/2020 | Dickinson | F04D 17/162 |
| 2005/0278927 | A1 * | 12/2005 | Campbell | F04D 29/601 29/446 |
| 2009/0291004 | A1 | 11/2009 | Grasmuck | |
| 2010/0054969 | A1 | 3/2010 | Grasmuck | |
| 2010/0189554 | A1 | 7/2010 | Grasmuck | |
| 2010/0307498 | A1 * | 12/2010 | Jones | F04D 29/601 128/204.21 |
| 2012/0199129 | A1 * | 8/2012 | Kenyon | F04D 17/16 128/205.25 |
| 2013/0028710 | A1 | 1/2013 | Kenyon | |
| 2013/0306072 | A1 * | 11/2013 | Moir | F04D 17/16 415/203 |
| 2014/0014109 | A1 * | 1/2014 | Grasmuck | A61M 16/0066 128/204.18 |
| 2019/0154056 | A1 * | 5/2019 | Godo | F04D 29/4226 |
| 2019/0390679 | A1 * | 12/2019 | Guntermann | F04B 35/04 |

* cited by examiner

BLOWER UNIT

CROSS-REFERENCE TO RELATED APPLICATIONS

This application claims the benefit of U.S. Provisional Patent Application Ser. No. 63/045,520 for a BLOWER UNIT, filed on 2020 Jun. 29, which is hereby incorporated by reference in its entirety. This application also claims the benefit of U.S. Provisional Patent Application Ser. No. 63/058,757 disclosing BLOWER MANUFACTURING AND TESTING, filed on 2020 Jul. 30, which is hereby incorporated by reference in its entirety.

BACKGROUND

1. Field

The present disclosure relates to blowers, devices that draw a gas into an inlet of a housing and directs the gas out of an outlet of the housing.

2. Description of Related Prior Art

U.S. Pat. No. 5,163,870 discloses a Protective Dust Cover for Computer Components. The dust cover for protecting a computer component includes an open bottom enclosure which completely covers the computer component and includes a lower edge having a compressible seal member which engages the resting surface on which the component is situated. The cover can be constructed from a clear acrylic material and can be provided with a notched opening in a rear wall for running electrical power supply cords and related wires therethrough. To provide for sufficient cooling of the enclosed component, an exhaust fan is located in an opening formed in the rear wall of the cover and draws cooling air through a separate replaceable filter element located in an inlet opening provided in the cover. If it is necessary to have access to the component such as the disk drive unit, a sliding access door can be provided at the appropriate location. In the preferred embodiment, two covers are used to form an assembly, with the lower cover provided to enclose a central processing unit housing (CPU), and an upper cover provided for enclosing a computer monitor.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A blower unit can include an outer housing, an inlet subassembly, a fan subassembly, an outlet subassembly, and a grommet. The outer housing can have an aperture centered on a first axis and extending between a first end and second end. The inlet subassembly can be at least partially received in the first end of the aperture and can define an inlet of the blower unit. The fan subassembly can be received in the aperture adjacent to the inlet subassembly and include at least one wire. The outlet subassembly can be at least partially received in the second end of the aperture and can define at least one outlet of the blower unit. The fan subassembly can be positioned between the inlet subassembly and the outlet subassembly along the first axis. The grommet can be positioned between at least part of the second end and the outlet subassembly. The at least one wire can extend through the grommet. The grommet can seal against the at least one wire. The grommet can seal between the outer housing and the outlet subassembly.

BRIEF DESCRIPTION OF THE DRAWINGS

The detailed description set forth below references the following drawings.

DETAILED DESCRIPTION

Figure 1:
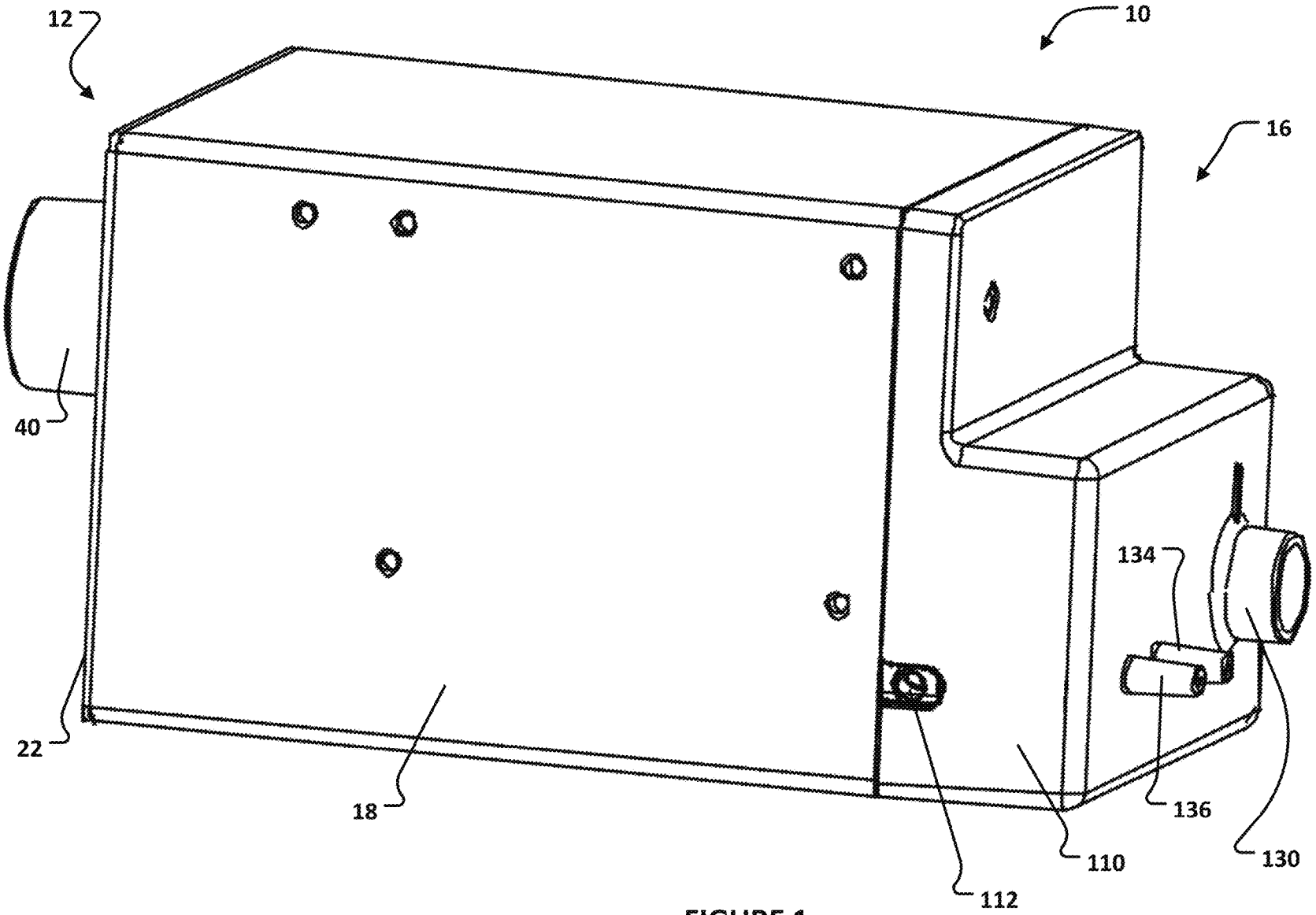
FIG. 1 is a first perspective view of a blower unit according to an exemplary embodiment of the present disclosure.
Figure 2:
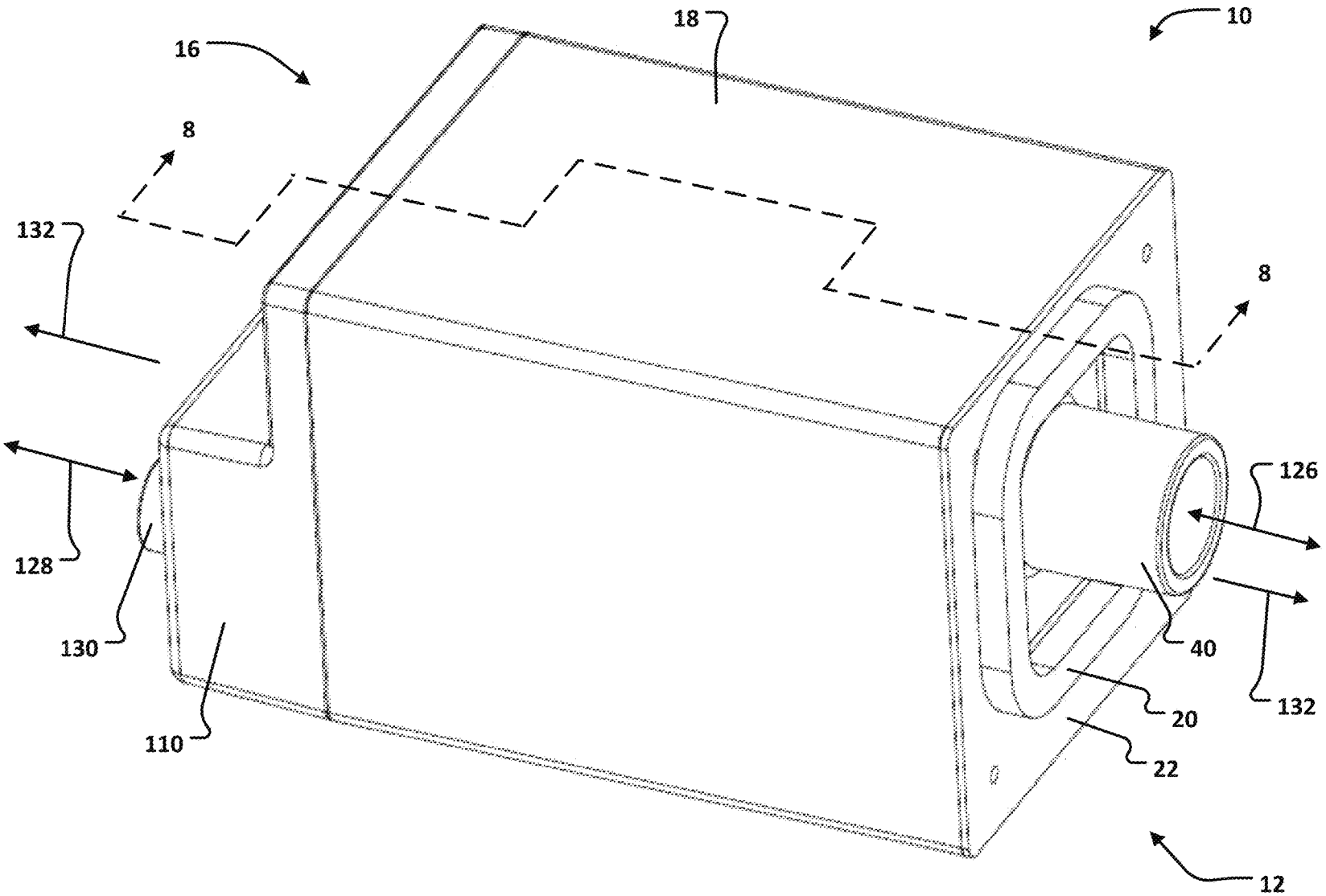
FIG. 2 is a second perspective view of the blower unit.

The present disclosure, as demonstrated by the exemplary embodiment described below, can provide an enhanced blower unit 10. The exemplary blower unit 10 is enhanced through component design an through assembly process. The exemplary blower unit 10 includes an inlet subassembly 12, a fan subassembly 14, an outlet subassembly 16, an outer housing 18, and a grommet 112.

Figure 3:
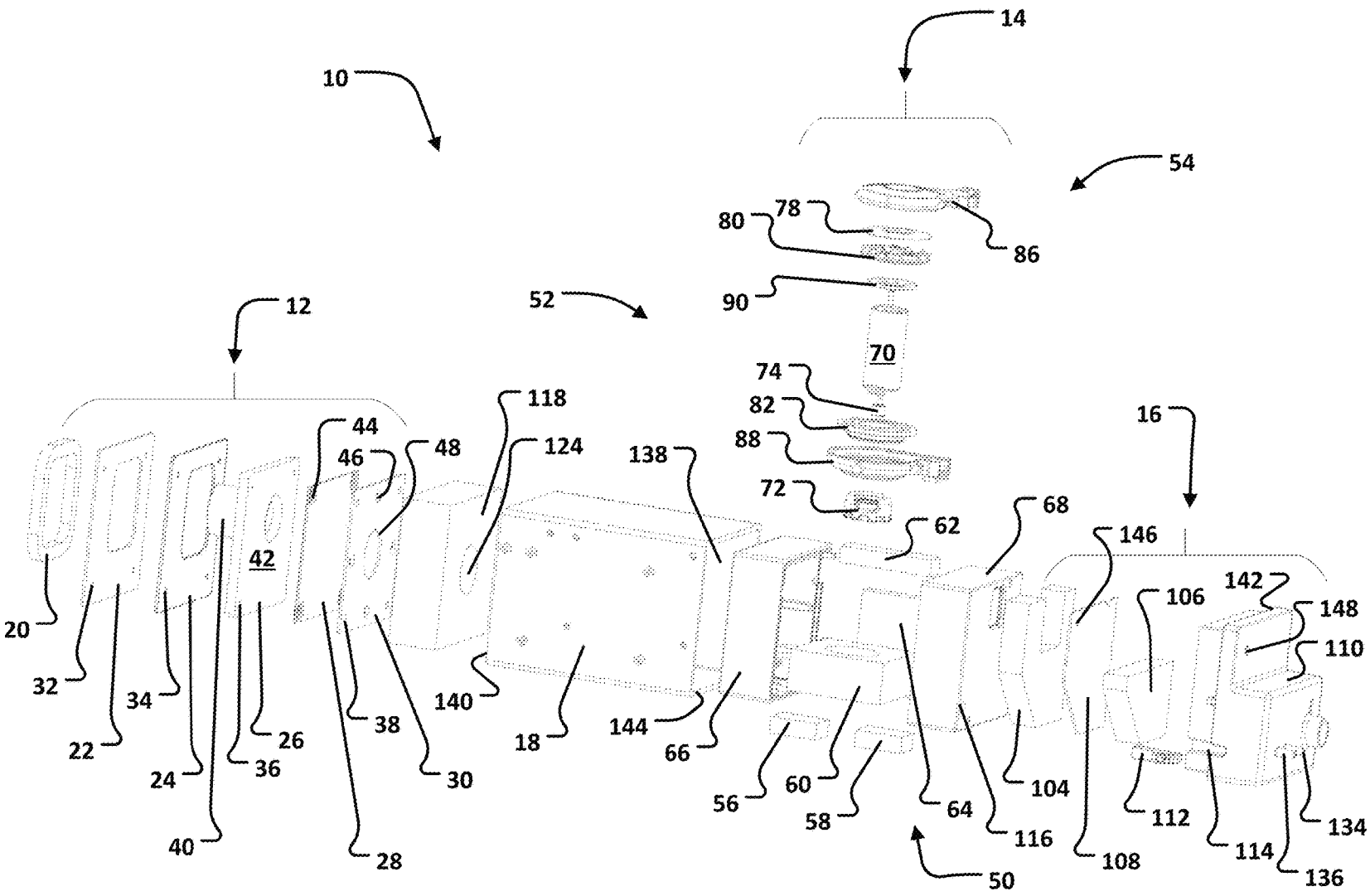
FIG. 3 is an exploded view of the blower unit.
Figure 4:
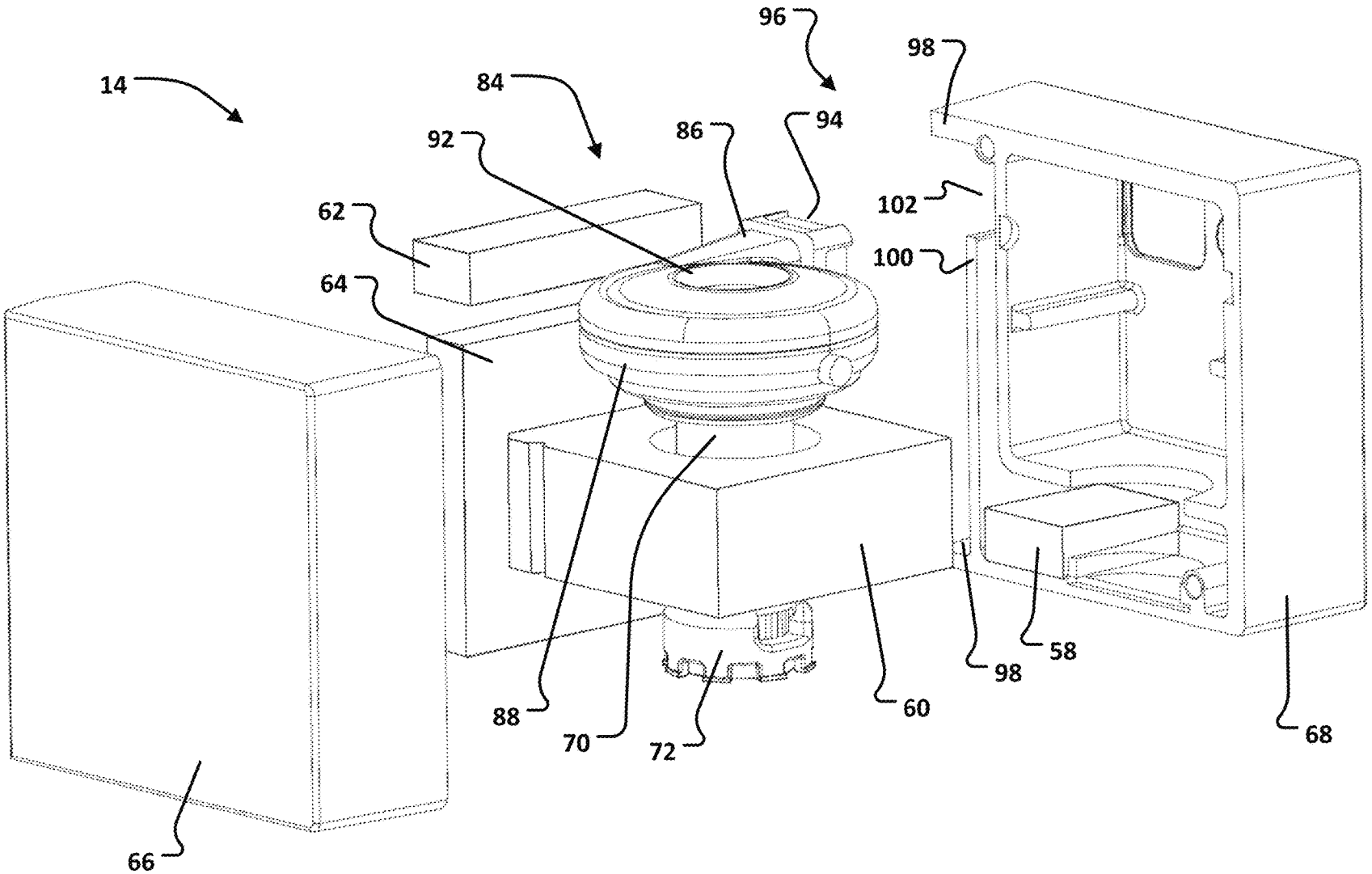
FIG. 4 is a first exploded view of a fan subassembly of the blower unit.
Figure 5:
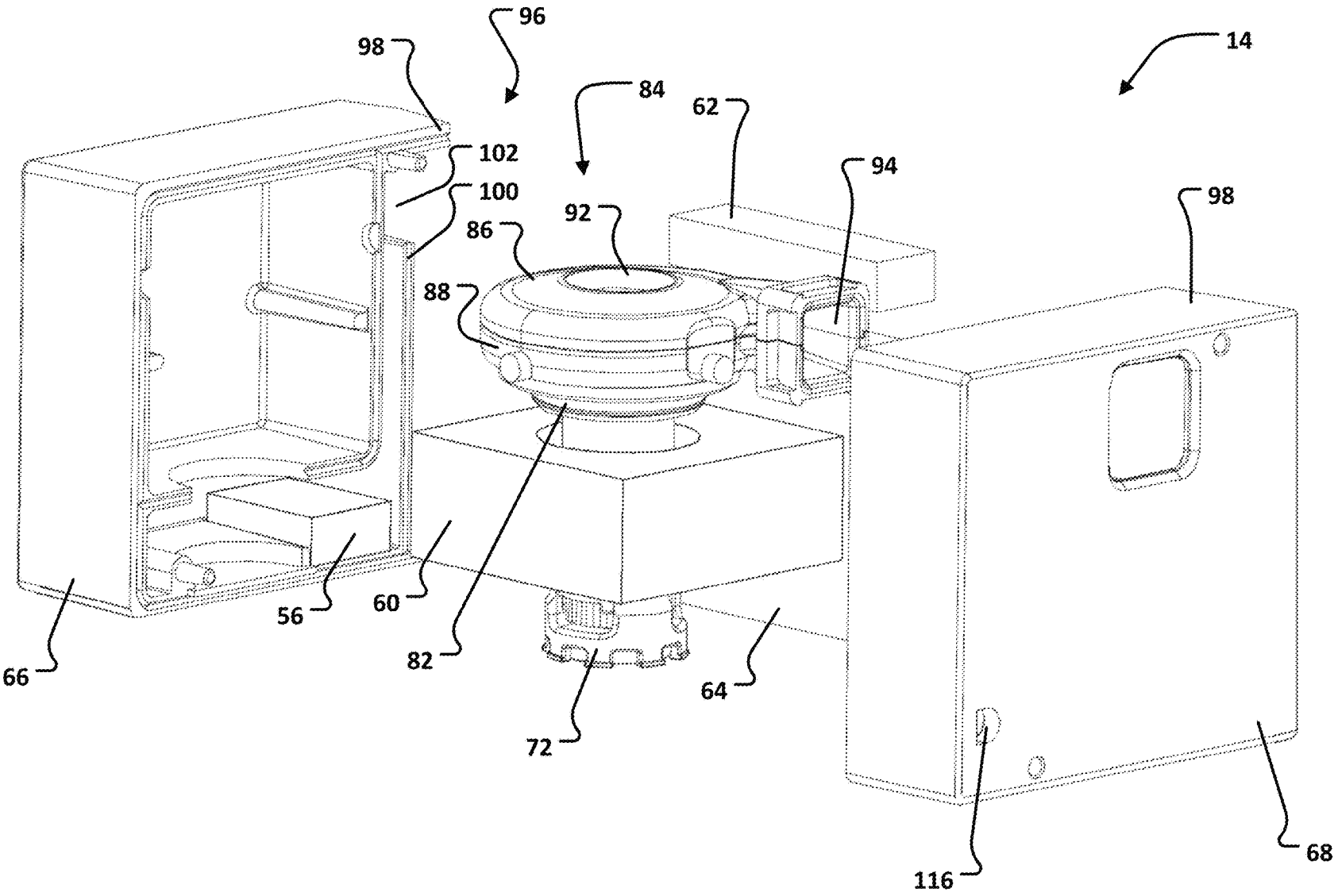
FIG. 5 is a second exploded view of the fan subassembly.
Figure 6:
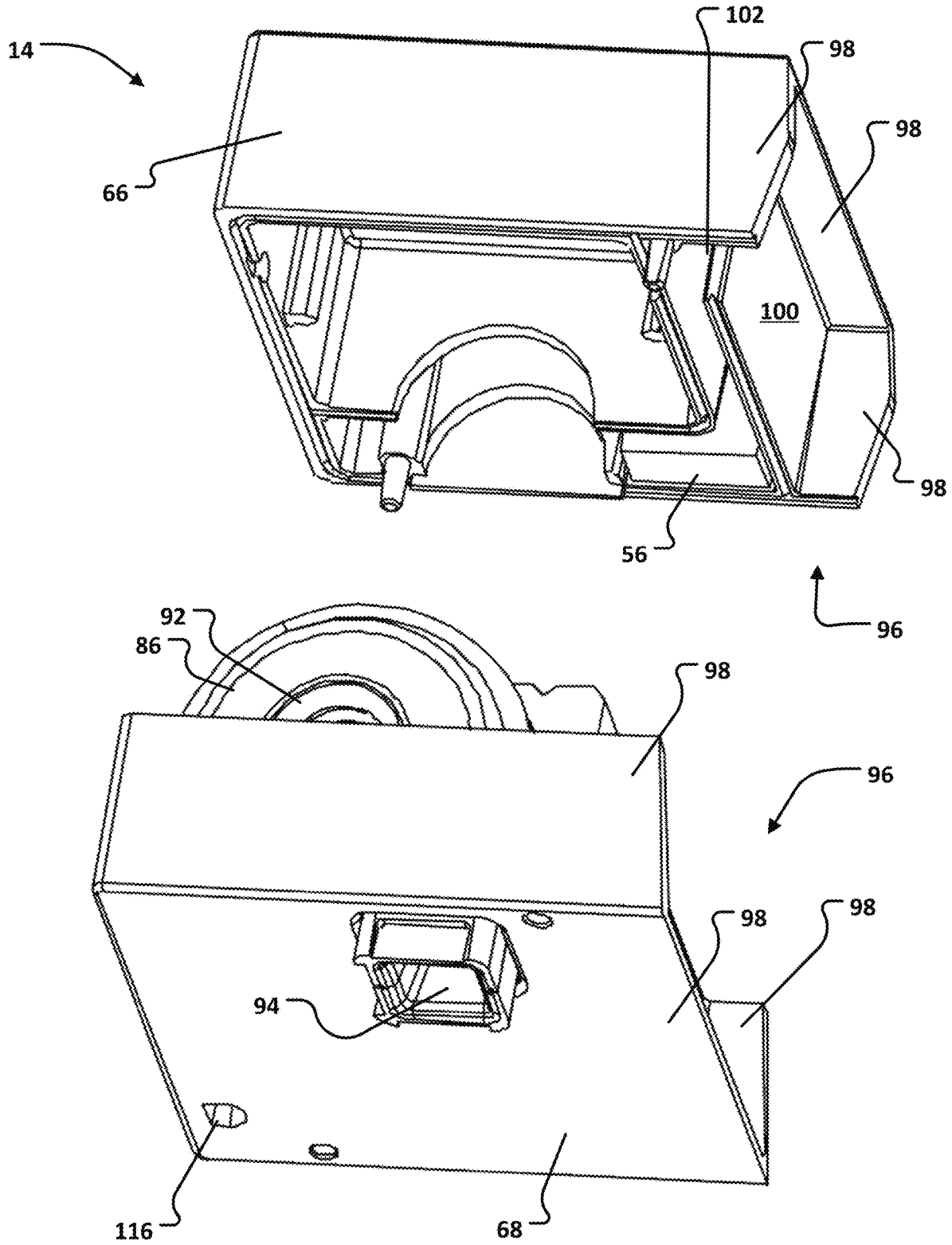
FIG. 6 is a third exploded view of the fan subassembly.
Figure 7:
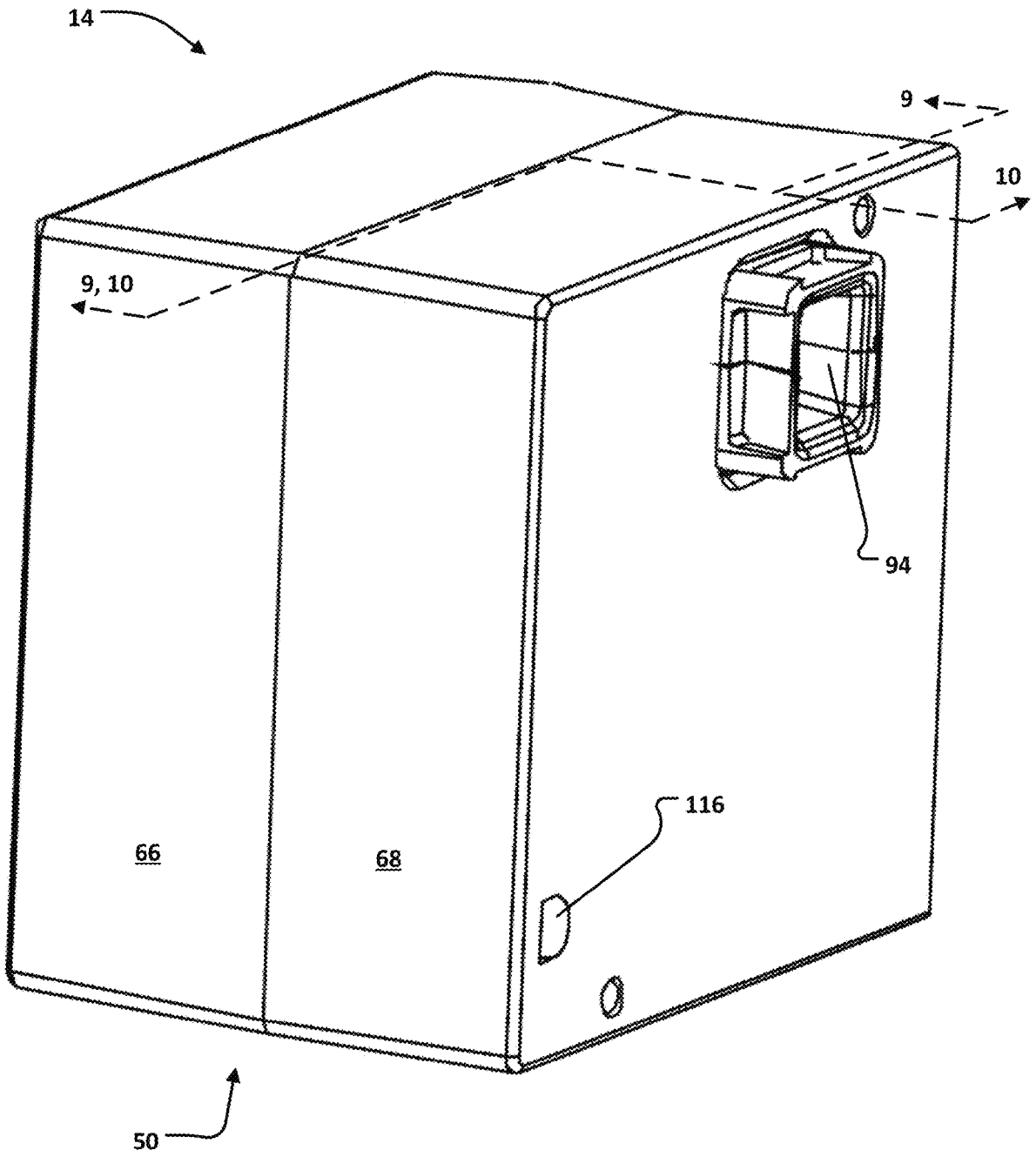
FIG. 7 is a first perspective view of the fan subassembly.

Referring now to FIG. 3, the exemplary inlet subassembly 12 includes a first gasket 20, a first plate 22, a second gasket 24, a manifold 26, a second plate 28, and a third plate 30. The exemplary first gasket 20 is connected to the first plate 22 with adhesive. The exemplary first plate 22, exemplary second gasket 24, exemplary manifold 26, and exemplary third plate 30 are interconnected with fasteners such as bolts that pass through aligned apertures (such as apertures 32, 34, 36, 38) in the respective first plate 22, second gasket 24, manifold 26, and third plate 30. The manifold 26 includes a tubular portion 40 and a plate portion 42. The tubular portion 40 defines an inlet of the blower unit 10 and extends through an aperture in the first plate 22 and also an aperture in the second gasket 24. The exemplary second plate 28 is positioned between the manifold 26 and third plate 30. As shown in FIG. 3, the second plate 28 is without apertures and directs all flow of air passing through the tubular portion 40 in a direction ninety degrees from the central axis 126 of the tubular portion 40. The exemplary second plate 28 includes standoffs 44 the project toward the manifold 26 so that a gap is defined between the exemplary second plate 28 and the exemplary manifold 26 when the components are assembled together. The exemplary third plate 30 also includes standoffs 46 that project toward the second plate 28 so that a gap is defined between the exemplary second plate 28 and the exemplary third plate 30 when the components are assembled together.

Referring now variously to FIGS. 3-7, the exemplary fan subassembly 14 includes a housing assembly 50, a motor assembly 52, a fan assembly 54, and sound dampeners 56, 58, 60, 62, 64. The exemplary housing assembly 50 includes first and second halves 66, 68 that can be glued together to enclose most of the remaining components of the exemplary fan subassembly 14. Alternatively, the first and second halves 66, 68 can be interconnected and a gasket can be interposed between the first and second halves 66, 68.

The exemplary motor assembly 52 includes a motor 70, a base 72, and a back balancing disc 74. The exemplary motor 70 is received in the exemplary base 72, which stabilizes the motor 70 within the exemplary housing assembly 50. The exemplary back balancing disc 74 is operably positioned between a shaft 76 of the exemplary motor 70 and the exemplary base 72. The exemplary motor 70, exemplary base 72, and exemplary back balancing disc 74 are positioned within the housing assembly 50.

The exemplary fan assembly 54 includes a cap 78, an impeller 80, a base 82, a casing 84 having a first half 86 and a second half 88, and a support plate 90. The exemplary cap 78 and impeller 80 can be glued together. The exemplary base 82 and second half 88 can be formed as a single, unitary structure or, in other embodiments, can be glued together. In assembly, the interconnected base 82 and second half 88 can be mounted on the motor 70. The support plate 90 can overlay the base 82 to attach the base 82 to the motor 70. Next, the interconnected cap 78 and impeller 80 can be mounted on the shaft 76 of the motor 70. Next, the first half 86 can be interconnected with the second half 88, such as with glue or with fasteners and a gasket therebetween. The interconnected first half 86 and second half 88, which is the exemplary casing 84, defines an inlet 92 and an outlet 94. The exemplary outlet 94 extends outside of the exemplary housing assembly 50. One or more wires, such as wire 150, can extend from the motor 70 and out of the housing assembly 50.

The exemplary sound dampeners 56, 58, 60 are positioned within the exemplary housing assembly 50 with the exemplary motor assembly 52 and the exemplary fan assembly 54. The exemplary sound dampeners 56, 58, 60, 62, 64 can be made of foam. Exemplary sound dampeners 56 and 58 are positioned within the exemplary housing assembly 50 and can be glued to the exemplary housing assembly 50. Exemplary sound dampener 60 is positioned within the exemplary housing assembly 50 and encircles the motor 70. Exemplary sound dampener 60 can be glued to the exemplary housing assembly 50. A circumferential gap is defined between the exemplary sound dampener 60 and the motor 70.

Exemplary sound dampener 62 is positioned against the outside of the exemplary housing assembly 50. As best shown in FIGS. 4-6 and 9, the exemplary housing assembly 50 defines a tray portion 96. The exemplary tray portion 96 includes a perimeter wall 98 formed by both halves 66, 68. The halves 66, 68 can be interconnected with fasteners and have a gasket therebetween, or can be glued together. The exemplary tray portion 96 is also formed by a bottom wall 100. The exemplary bottom wall 100 does not extend fully between the four sides of the perimeter wall 98, thus defining a gap 102. Exemplary sound dampener 62 is positioned in the gap 102 and the exemplary sound dampener 64 occupies the remainder of the exemplary tray portion 96.

The exemplary outlet subassembly 16 includes sound dampeners 104 and 106, a plate 108, and a manifold 110. The exemplary sound dampeners 104 and 106 and the exemplary plate 108 are positioned within the exemplary manifold 110. The exemplary plate 108 is positioned between the exemplary sound dampeners 104 and 106. The exemplary sound dampeners 104 and 106 can be glued to the exemplary plate 108. The exemplary plate 108 and the exemplary manifold 110 are interconnected by a fastener extending through respective apertures 146, 148.

The exemplary grommet 112 is received in a slot 114 defined by the manifold 110. The exemplary grommet 112 is also received in a aperture 116 defined by the second half 68 of housing assembly 50. The exemplary aperture 116 of the fan subassembly 14 is non-circular and more specifically D-shaped in cross-section. Wiring can extend from the motor 70, through the grommet 112, and out of the blower unit 10. The grommet 112 includes a central longitudinal axis 152 and extends between a first end 154 and second end 156 along the central longitudinal axis 152. The first end of the grommet 112 can be positioned in the slot 114 defined in an outer surface 160 of the outlet subassembly 16 and the second end 156 of the grommet 112 received in the aperture 116 of the outer housing 50.

The exemplary slot 114 defines a gap in the exemplary edge 142. The exemplary grommet 112 includes a step-profile 158 that bridges the gap in the exemplary edge 142. The exemplary step-profile 158 abuts the second end 144 of an aperture 138 of the outer housing 18.

In assembling the blower unit 10, the exemplary inlet subassembly 12, the exemplary fan subassembly 14, and the exemplary outlet subassembly 16 can all be assembled separately and then combined. The exemplary fan subassembly 14 can be positioned in the aperture 138 extending through the outer housing 18. One on side of the exemplary fan subassembly 14, in the upstream direction of flow through the blower unit 10, another sound dampener 118 can positioned in the outer housing 18. The exemplary inlet subassembly 12 can then be positioned next to the exemplary sound dampener 118. The exemplary inlet subassembly 12 can be sealed relative to the exemplary outer housing 18 via the second gasket 24. The perimeter of the plate 22 and gasket 24 can be glued to and sealed against an edge 140 of a first end of the aperture 138 of the outer housing 18.

Figure 8:
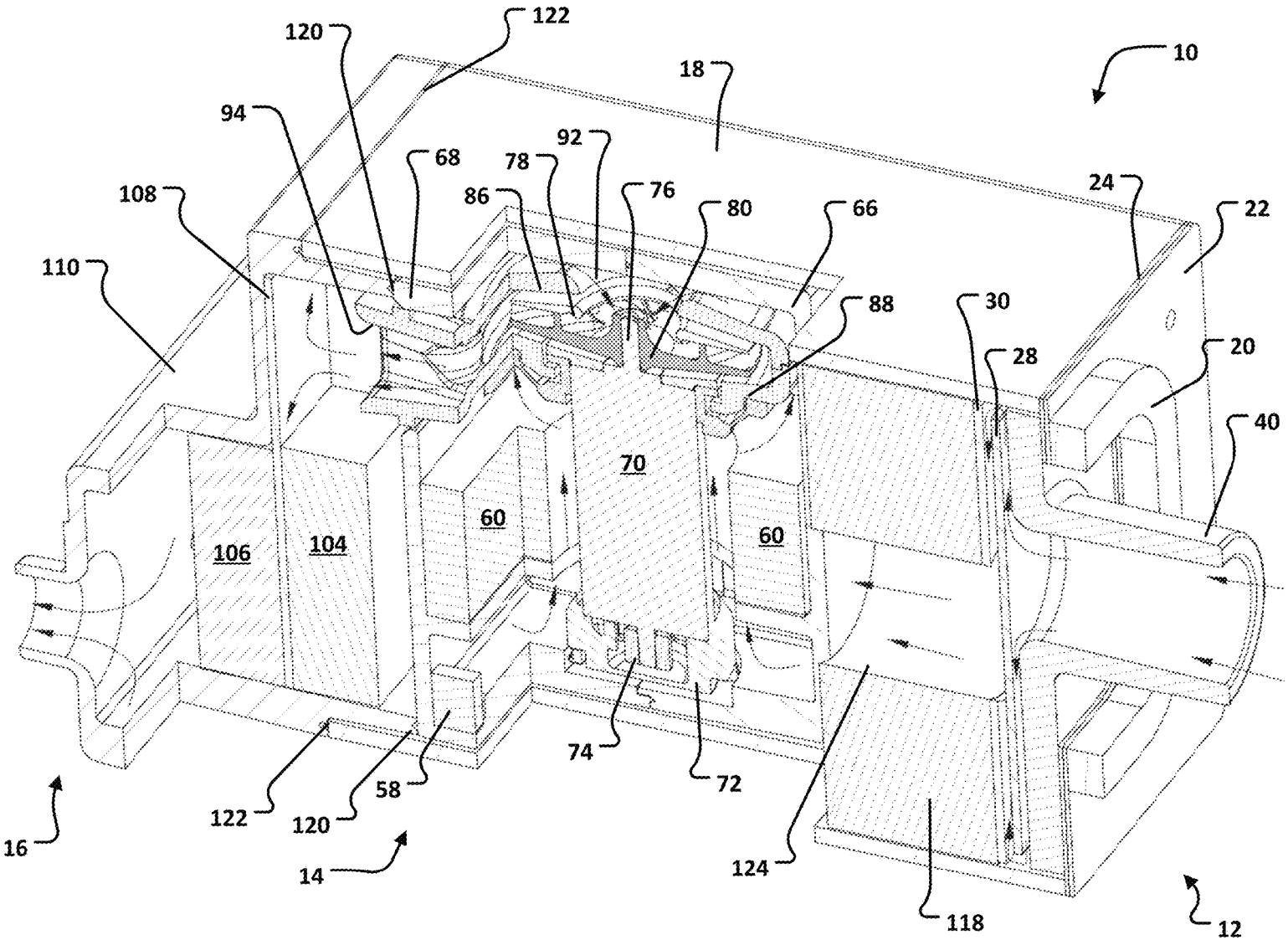
FIG. 8 is a perspective view of the blower unit with a multi-planar cut-out taken along the section line 8-8 shown in FIG. 2.

The downstream side of the exemplary fan subassembly 14 is partially received in the exemplary outlet subassembly 16. The exemplary fan subassembly 14 and the exemplary outlet subassembly 16 can be interconnected with glue. A bead of glue can be dispensed around a perimeter between the exemplary fan subassembly 14 and the exemplary outlet subassembly 16 referenced at 120 in FIG. 8. The exemplary outlet subassembly 16 and the outer housing can be glued together through a bead of glue dispensed around a perimeter between the exemplary outer housing 18 and the exemplary outlet subassembly 16 referenced at 122 in FIG. 8. The beads of glue can interconnect and seal the respective components. The inlet manifold 26, outlet manifold 110, and the outer housing 18 can be joined as a final assembly unit by either glue or fasteners/gasket. An edge 142 of the manifold 110 can be glued to and sealed against an edge 144 of a second end of the aperture 138 of the outer housing 18.

Air flow through the blower unit 10 is referenced by unnumbered arrows in FIG. 8-11. Air that is drawn into the blower unit 10 is received in the tubular portion 40 of the manifold 26. The air flow then passes around the perimeter of the exemplary second plate 28 and into the gap between the second plate 28 and the third plate 30. The air flow then passes through an aperture in the third plate, such as a central aperture 48. The air flow then passes through an aperture 124 in the sound dampener 118.

Figure 9:
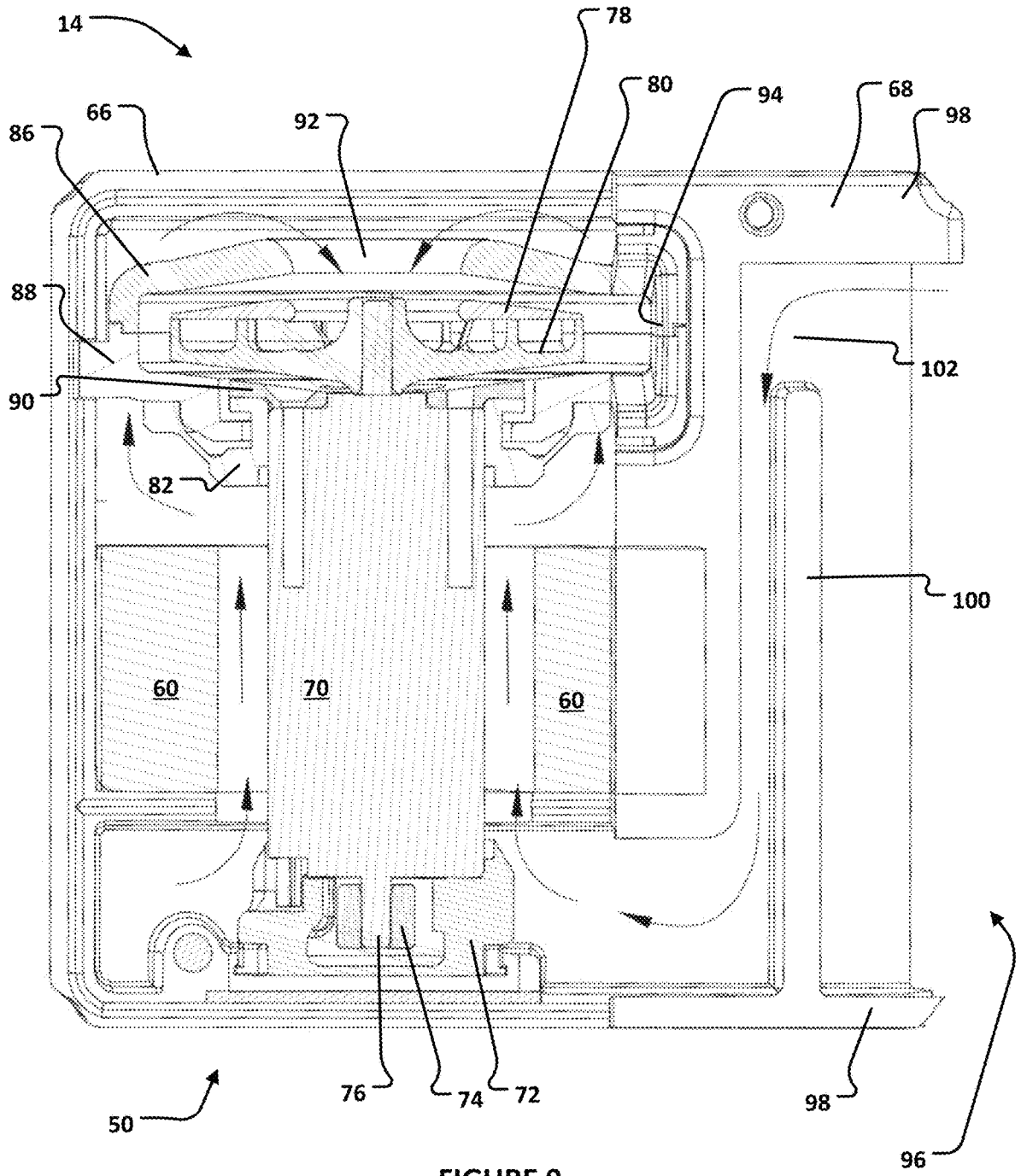
FIG. 9 is a perspective view of the fan subassembly with a multi-planar cut-out taken along the section line 9-9 shown in FIG. 7.
Figure 10:
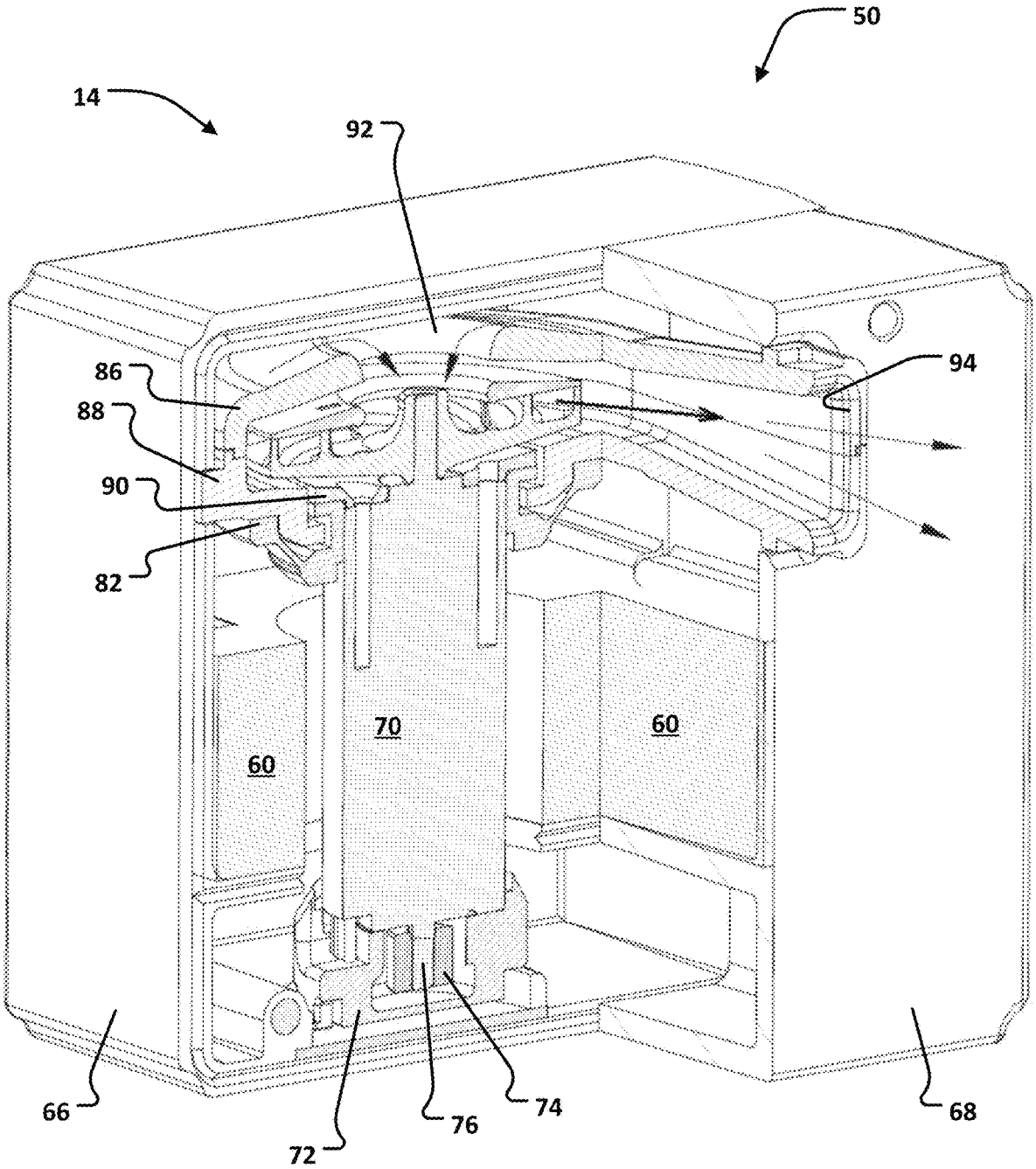
FIG. 10 is a perspective view of the fan subassembly with a multi-planar cut-out taken along the section line 10-10 shown in FIG. 7.

Next, the flow is directed laterally around the fan subassembly 14 to be received in the tray portion 96, as best shown in FIG. 9. Air travels behind the bottom wall 100, past the base 72 of the exemplary motor subassembly 52, between the motor 70 and the sound dampener 60, around the casing 84, and into the inlet 92. This portion of the flow path is substantially normal to a central axis 126 of the tubular portion 40 and also to a central axis 128 of a tubular portion 130 of the manifold 110.

Figure 11:
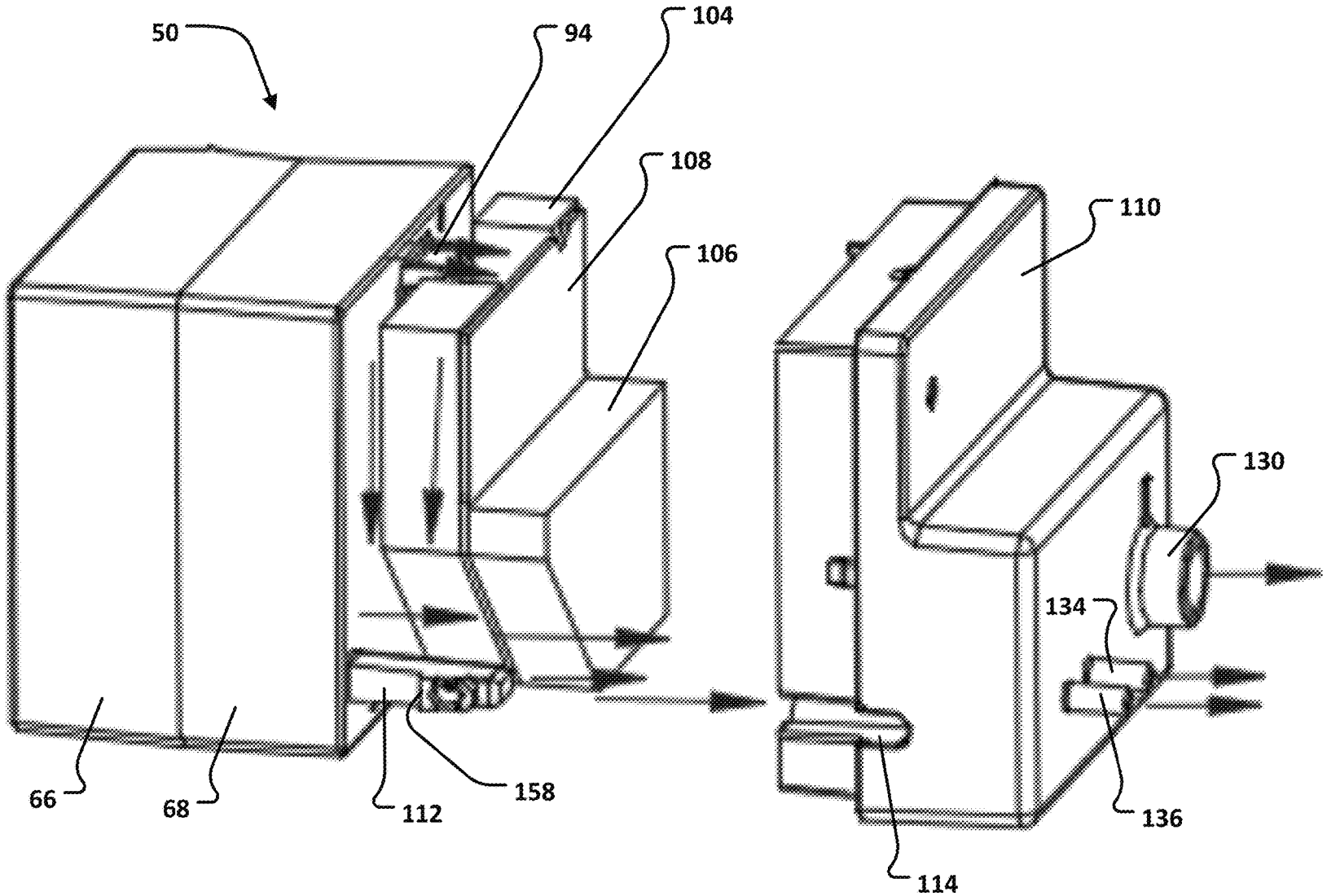
FIG. 11 is a perspective view of the fan subassembly and an outlet subassembly of the blower unit, exploded relative to one another.
Figure 12:
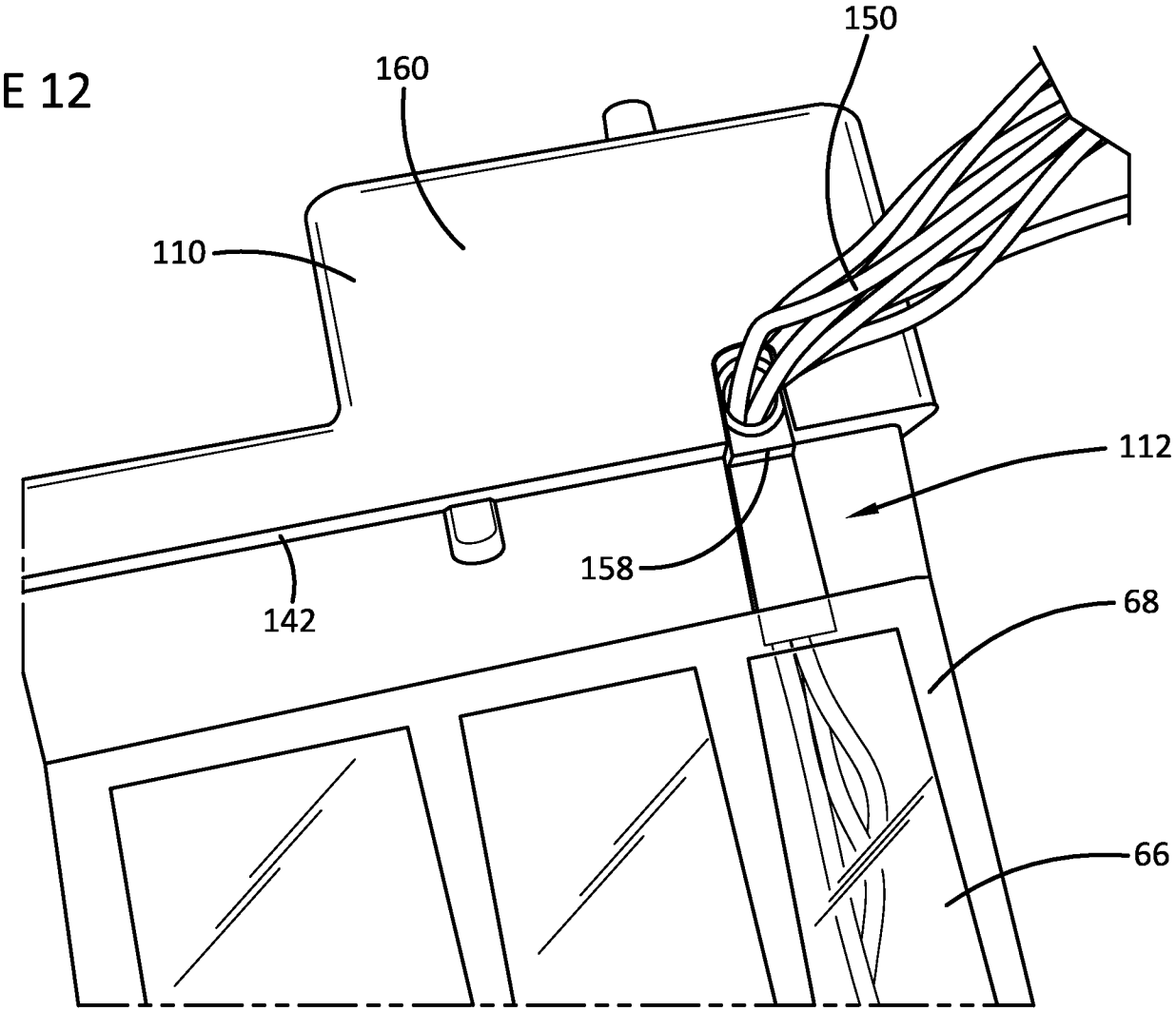
FIG. 12 is a perspective view of a portion of the fan subassembly and the outlet subassembly assembly together.
Figure 13:
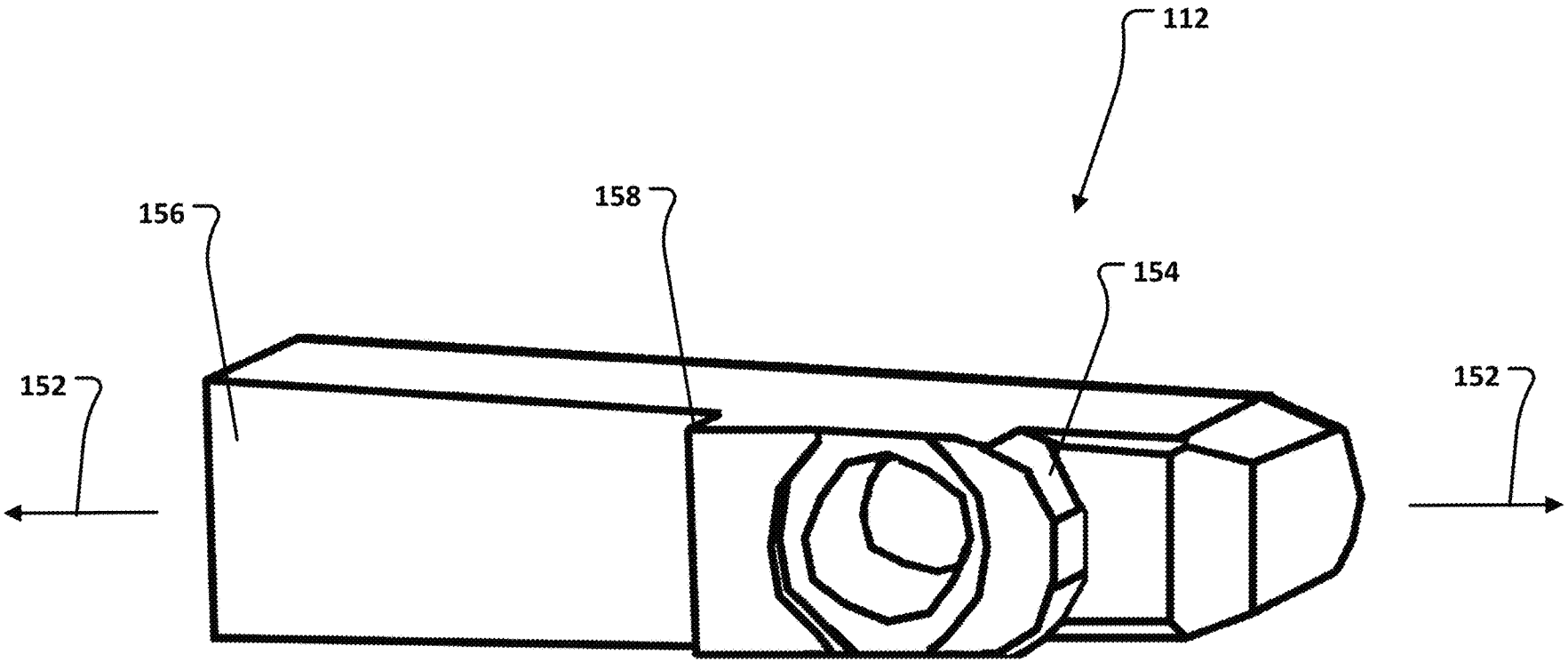
FIG. 13 is a perspective view of a grommet according to an exemplary embodiment of the present disclosure.

The air flow is directed outward through the outlet 94 by the fan assembly 54 generally in a direction parallel to the axes 126, 128. The fan subassembly 14 thus directs a flow of air in a direction parallel to the axis 132. As best shown in FIG. 11, the air flow is then again directed laterally, around the axis 132, a direction ninety degrees from the axis 132 by the sound dampener 104, which is a first portion of the outlet subassembly 16. The flow travels generally one hundred and eighty degrees around a central axis 132 of the passageway through the outer housing 18 and reaches a passageway bounded by the second half 68, the manifold 110, the sound dampeners 104 and 106, and the plate 108. The axis 132 is parallel to the axes 126, 128. Generally, the passageway, a second portion of the outlet subassembly 16, guides the flow along an axis that is parallel to the axes 126, 128, and 132. The air flow proceeds to outlets of the exemplary blower unit 10, which are defined by the tubular portion 130 as well as two additional outlets 134, 136. Flow can proceed directly out of the outlets 134, 136. Flow can proceed to the tubular portion 130 by first passing through the sound dampener 106. It is noted that one or more of the tubular portion 130 and the outlets 134, 136 can be closed with a cap if desired.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein is hereby unconditionally reserved. The use of the word "can" in this document is not an assertion that the subject preceding the word is unimportant or unnecessary or "not critical" relative to anything else in this document. The word "can" is used herein in a positive and affirming sense and no other motive should be presumed. More than one "invention" may be disclosed in the present disclosure; an "invention" is defined by the content of a patent claim and not by the content of a detailed description of an embodiment of an invention.

What is claimed is:

1. A blower unit comprising:

an outer housing having an aperture centered on a first axis and extending between a first end and second end;

an inlet subassembly at least partially received in said first end of said aperture and defining an inlet of said blower unit;

a fan subassembly received in said aperture adjacent to said inlet subassembly and including at least one wire;

an outlet subassembly at least partially received in said second end of said aperture and defining at least one outlet of said blower unit, said fan subassembly positioned between said inlet subassembly and said outlet subassembly along said first axis;

a grommet positioned between at least part of said second end and said outlet subassembly, said at least one wire extending through said grommet, said grommet sealing against said at least one wire, wherein said grommet seals between said outer housing and said outlet subassembly;

wherein said grommet includes a central longitudinal axis and extends between a first end and second end along said central longitudinal axis, said first end of said grommet positioned in a slot defined in an outer surface of said outlet subassembly and said second end of said grommet received in said aperture of said outer housing; and wherein said second end of said aperture abuts an edge defined by said outlet subassembly about said first axis, said slot defines a gap in said edge, said grommet includes a step-profile that bridges said gap in said edge, and said step-profile abuts said second end of said aperture.

2. The blower unit of claim 1 wherein said second end of said grommet is positioned in an aperture defined by said fan subassembly.

3. The blower unit of claim 2 wherein said aperture of said fan subassembly is D-shaped in cross-section.

4. The blower unit of claim 1 wherein said outlet subassembly further comprises:

a manifold having a tubular portion;

a plate connected with the manifold; and a plurality of sound dampeners including at least two sound dampeners respectively positioned on opposite sides of said plate, wherein said second end of said aperture abuts an edge defined by said manifold.

5. The blower unit of claim 1 wherein:

said fan subassembly directs a flow of air in a direction parallel to said first axis; and a first portion of said outlet subassembly diverts the flow of air passing out of said fan subassembly in a direction ninety degrees from said first axis.

6. The blower unit of claim 5 wherein a second portion of said outlet subassembly, downstream of said first portion, diverts the flow of air received from said first portion in a direction parallel to said first axis.

7. A blower unit comprising:

an outer housing having an aperture centered on a first axis and extending between a first end and second end;

an inlet subassembly at least partially received in said first end of said aperture and defining an inlet of said blower unit;

a fan subassembly received in said aperture adjacent to said inlet subassembly and including at least one wire;

an outlet subassembly at least partially received in said second end of said aperture and defining at least one outlet of said blower unit, said fan subassembly positioned between said inlet subassembly and said outlet subassembly along said first axis;

a grommet positioned between at least part of said second end and said outlet subassembly, said at least one wire extending through said grommet, said grommet sealing against said at least one wire, wherein said grommet seals between said outer housing and said outlet subassembly; and wherein said grommet includes a central longitudinal axis and extends between a first end and second end along said central longitudinal axis, said second end of said grommet positioned in an aperture defined by said fan subassembly within said outer housing.

8. The blower unit of claim 7 wherein said aperture of said fan subassembly is non-circular in cross-section.

9. The blower unit of claim 7 wherein said outlet subassembly further comprises:

a manifold having a tubular portion;

a plate connected with the manifold; and a plurality of sound dampeners including at least two sound dampeners respectively positioned on opposite sides of said plate, wherein said second end of said aperture abuts an edge defined by said manifold.

10. The blower unit of claim 7 wherein:

said fan subassembly directs a flow of air in a direction parallel to said first axis; and a first portion of said outlet subassembly diverts the flow of air passing out of said fan subassembly in a direction ninety degrees from said first axis.

11. The blower unit of claim 10 wherein a second portion of said outlet subassembly, downstream of said first portion, diverts the flow of air received from said first portion in a direction parallel to said first axis.

12. A blower unit comprising:

an outer housing having an aperture centered on a first axis and extending between a first end and second end;

an inlet subassembly at least partially received in said first end of said aperture and defining an inlet of said blower unit;

a fan subassembly received in said aperture adjacent to said inlet subassembly and including at least one wire;

an outlet subassembly at least partially received in said second end of said aperture and defining at least one outlet of said blower unit, said fan subassembly positioned between said inlet subassembly and said outlet subassembly along said first axis;

a grommet positioned between at least part of said second end and said outlet subassembly, said at least one wire extending through said grommet, said grommet sealing against said at least one wire, wherein said grommet seals between said outer housing and said outlet subassembly; and wherein said inlet subassembly further comprises:

a first gasket;

a first plate connected to said first gasket with adhesive and having a first aperture;

a second gasket connected to said first plate and having a second aperture;

a manifold having a tubular portion and a plate portion, said tubular portion extending through said first aperture and said second aperture, said second gasket positioned between said plate portion and said first plate, said manifold connected to said second gasket and said first plate;

a second plate immediately adjacent to said plate portion and having a first plurality of standoffs projecting toward said manifold so that a first gap is defined between said second plate and said manifold; and a third plate having a second plurality of standoffs projecting toward said second plate so that a second gap is defined between said second plate and said third plate.

13. The blower unit of claim 12 wherein said second plate is without apertures and directs all flow of air passing through said tubular portion in a direction ninety degrees from a central axis of said tubular portion.

14. The blower unit of claim 12 wherein said outlet subassembly further comprises:

a plurality of sound dampeners including at least two sound dampeners respectively positioned on opposite sides of one of said first plate and said second plate and said third plate, wherein said second end of said aperture abuts an edge defined by said manifold.

15. The blower unit of claim 12 wherein:

said fan subassembly directs a flow of air in a direction parallel to said first axis; and a first portion of said outlet subassembly diverts the flow of air passing out of said fan subassembly in a direction ninety degrees from said first axis.

16. The blower unit of claim 15 wherein a second portion of said outlet subassembly, downstream of said first portion, diverts the flow of air received from said first portion in a direction parallel to said first axis.

17. A blower unit comprising:

an outer housing having an aperture centered on a first axis and extending between a first end and second end;

an inlet subassembly at least partially received in said first end of said aperture and defining an inlet of said blower unit;

a fan subassembly received in said aperture adjacent to said inlet subassembly and including at least one wire;

an outlet subassembly at least partially received in said second end of said aperture and defining at least one outlet of said blower unit, said fan subassembly positioned between said inlet subassembly and said outlet subassembly along said first axis;

a grommet positioned between at least part of said second end and said outlet subassembly, said at least one wire extending through said grommet, said grommet sealing against said at least one wire, wherein said grommet seals between said outer housing and said outlet subassembly; and wherein said fan subassembly further comprises:

a housing assembly having first and second halves;

a motor assembly having a motor, a base, and a back balancing disc positioned within the housing assembly;

a fan assembly having a cap, an impeller, a base, a casing, and a support plate, said fan assembly positioned within the housing assembly; and a plurality of sound dampeners positioned within the housing assembly, including at least one sound dampener encircling the motor with a circumferential gap defined between the at least one sound dampener and the motor.

18. The blower unit of claim 17 wherein said housing assembly defines a tray portion with a perimeter wall having four sides and a bottom wall that does not extend fully between said four sides of said perimeter wall, thus defining a gap.

19. The blower unit of claim 17 wherein said housing assembly defines an aperture and a portion of said grommet is received in said aperture.

20. The blower unit of claim 17 wherein said outlet subassembly further comprises:

a manifold having a tubular portion;

a plate connected with the manifold; and a plurality of sound dampeners including at least two sound dampeners respectively positioned on opposite sides of said plate, wherein said second end of said aperture abuts an edge defined by said manifold.

21. The blower unit of claim 17 wherein:

said fan subassembly directs a flow of air in a direction parallel to said first axis; and a first portion of said outlet subassembly diverts the flow of air passing out of said fan subassembly in a direction ninety degrees from said first axis.

22. The blower unit of claim 21 wherein a second portion of said outlet subassembly, downstream of said first portion, diverts the flow of air received from said first portion in a direction parallel to said first axis.

* * * * *